US005969288A

United States Patent [19]

Baud

[11] Patent Number: 5,969,288

[45] Date of Patent: Oct. 19, 1999

[54] CARTRIDGE CASE, ESPECIALLY FOR A SMOOTH BORE GUN

[75] Inventor: Jean-Jacques Baud, Saint-Peray, France

[73] Assignee: Cheddite France, Bourg les Valence, France

[21] Appl. No.: 08/852,472

[22] Filed: May 7, 1997

[51] Int. Cl.[6] ..... F42B 5/30

[52] U.S. Cl. ..... 102/466; 102/488; 102/469

[58] Field of Search ..... 102/466, 467, 102/469, 470, 448, 464, 465

[56] References Cited

U.S. PATENT DOCUMENTS

| | | | |
|---|---|---|---|
| 3,359,906 | 12/1967 | Herter . | |
| 3,722,412 | 3/1973 | Herter . | |
| 4,132,173 | 1/1979 | Amuchastegui | 102/469 |
| 4,140,058 | 2/1979 | Ballreich et al. | 102/466 |
| 4,192,233 | 3/1980 | Dumortier | 102/466 |

FOREIGN PATENT DOCUMENTS

| | | | |
|---|---|---|---|
| 859068 | 3/1978 | Belgium . | |
| B1 0-308352 | 3/1989 | European Pat. Off. . | |
| 1-113479 | 3/1956 | France . | |
| 2-126516 | 10/1972 | France . | |
| 2-199860 | 4/1974 | France . | |
| 2-309830 | 11/1976 | France . | |
| 2376395 | 9/1978 | France | 102/466 |
| 2-323980 | 8/1980 | France . | |
| 2-475209 | 8/1981 | France . | |
| 458996 | 8/1968 | Switzerland . | |
| 2969 | 12/1889 | United Kingdom | 102/469 |

*Primary Examiner*—Harold J. Tudor
*Attorney, Agent, or Firm*—Oliff & Berridge, PLC

[57] ABSTRACT

Cartridge case (1), especially for a smooth bore gun, comprising three elements made of plastic, namely a tubular body (2) with an assembly end (2*a*) which tapers into the shape of a cone frustum, a base (3) which has a frustoconical bore (3*a*) with substantially the same vertex angle as the tapering end (2*a*) of the tubular body, to which it is matched in order to act as a housing, and a bottom piece (4) with a frustoconical external profile of substantially the same vertex angle as the tapering end (2*a*) of the tubular body, and as the bore (3*a*) of the base (3).

2 Claims, 1 Drawing Sheet

CARTRIDGE CASE, ESPECIALLY FOR A SMOOTH BORE GUN

BACKGROUND OF THE INVENTION

The present invention relates to a cartridge case specially for a smooth bore gun.

More specifically, and in accordance with document EP-A-0 308 352, the present invention relates to a cartridge case comprising three elements made of plastic, namely:

- a tubular body, made of semi-rigid plastic, such as high-density polyethylene, with an assembly end which tapers into the shape of a cone frustum;
- a base, made of a very rigid plastic such as polyoxymethylene, which has a frustoconical bore with substantially the same vertex angle as the tapering assembly end of the tubular body, to which it is matched in order to act as a housing;
- a bottom piece, made of slightly flexible and elastic plastic such as a polyethylene or a polyamide, with a frustoconical external profile of substantially the same vertex angle as the tapering end of the tubular body and as the bore of the base;
- the respective dimensions of the bore of the base and of the frustoconical external profile of the bottom piece being such that when these components are assembled, the annular gap between them has a width smaller than the thickness of the tapering end of the tubular body;
- as well as means for snap-fastening the base and the bottom piece together.

The object of the present invention is to improve the mechanical integrity and sealing of the assembled cartridge, on the one hand, as regards the previously defined case, and on the other hand, as regards a priming device or primer mounted in the bottom piece. This is because in a multi-barrel or multiple shot gun, the combustion of the powder contained in a struck cartridge subjects any neighboring cartridge, which has not been struck, to a shock or even to repeated shocks adversely affecting or even reducing its mechanical strength, or even the overall sealing of the previously defined case.

The subject of the present invention is a cartridge case as previously defined, making it possible to improve and preserve the sealing of the combustion chamber defined by the inside of the tubular body, the recess that there is in the bottom piece, and the posterior face of the priming device or primer fitted into a housing provided for this purpose in the bottom piece. This is because this sealing is essential for improving the efficiency of the cartridge.

SUMMARY OF THE INVENTION

After various trials, in accordance with the invention, it was discovered that the mechanical strength of the previously defined assembly and the sealing thereof could be substantially improved by the interaction of the following means:

- differentiating the required functions of mechanical integrity and of sealing in the frustoconical region of connection between the tapering assembly end and the frustoconical bore of the base, and for this, making a sealing region and an assembly region which are distinct and superimposed in the axial direction of the tubular body interact in this connection region;
- obtaining this assembly region in the form of a welded plastic joint, known per se, between the tapering end of the tubular body and the frustoconical bore of the base; this joint is obtained by placing, using appropriate tooling defining a gap of trapezoidal diametral cross-section, the wall of said tapering end of the tubular body and the lateral wall facing it of the base, between the two electrodes of a sonotrode;
- obtaining this sealing region by tightly fitting together on the one hand, a lip belonging to the base, and on the other hand, a ring belonging to the tapering assembly end of the tubular body, fitted into said lip, this sealing region being arranged above the region of welding, in the direction in which the base is arranged at the bottom of the cartridge case; this sealing means is therefore different from the wedging or crushing of the tapering end of the tubular body between the bore of the base and the external profile of the bottom piece, as described in document EP-A-0308352;
- the arrangement of the anterior boundary of the tubular body some distance from a posterior shoulder of the base, this also making it possible to limit the wall thickness of the base, which wall is arranged between the two electrodes of the sonotrode during welding, and thus making it possible to obtain a continuous and therefore sealing welded joint;
- and limiting the extension, along a generatrix of the frustoconical connecting region, of the region for assembly using plastic welding between, on the one hand, a frontal boundary or circumferential line distant from or identical to the anterior boundary of the tubular body, that is to say its assembly end, and, on the other hand, a distal boundary short of the posterior circumferential line of contact between said base and the tapering assembly end of the tubular body, this being in order to maintain most of the taper wedging effect between the tapering end and the frustoconical bore of the base in the sealing region.

In accordance with the present invention, the following improvement is therefore made, and the frustoconical connection between the tapering assembly end and the frustoconical bore of the base in the axial direction of the tubular body comprises:

- a region of sealed connection between a ring belonging to the tapering assembly end of the tubular body and a lip belonging to the base and into which said ring is fitted, said sealed connection region extending from the posterior line of contact between the base and said assembly end;
- a collar of welding between the assembly end and the frustoconical bore of the base, extending from a distal boundary adjacent to or some distance from the sealed connection region to a frontal boundary adjacent to or distant from the anterior boundary of the tubular body;
- this anterior boundary of the tubular body being arranged some distance from a posterior shoulder of the base.

Thanks to the invention, the following advantages are also obtained.

The sealed connection region can perform its function to the full because it is not stiffened by the welded assembly region, and because it can therefore deform freely, especially when the cartridge is fired.

The distance or gap which there is between the anterior boundary of the tubular body and the posterior shoulder of the base makes it possible to absorb variations in length of the tubular body when the case is being assembled, in order to maintain the overall and nominal length of the cartridge case. What is more, this gap forms a dead volume between the base and the tubular body, making it possible to deaden the gunshot.

BRIEF DESCRIPTION OF THE FIGURE

The present invention is now described with reference to the single FIGURE which represents a view in diametral section of a cartridge case in accordance with the invention.

DESCRIPTION OF THE PREFERRED EMBODIMENT

Figure 1:
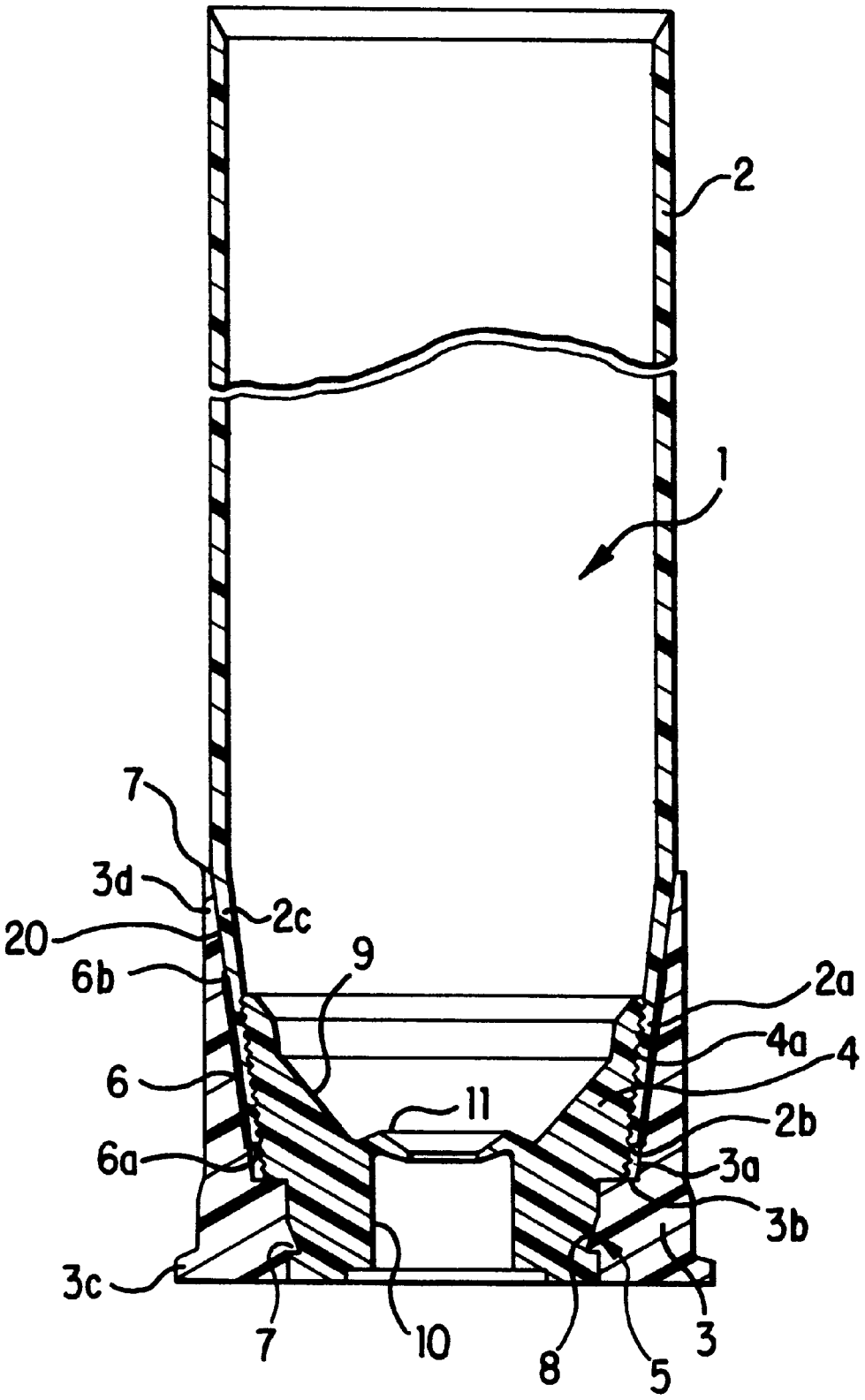

The case 1 according to the invention is of the type which consists of three elements made of plastic, namely a tubular body 2, a base 3 and a bottom piece 4.

The tubular body 2 represented in the FIGURE has an assembly end 2*a* which tapers into the shape of a cone frustum with a vertex angle of the order of 10 to 15°.

The base 3, which includes a peripheral collar 3*c* intended to catch on the extractor which pulls the case out of the chamber after striking, has a frustoconical bore 3*a* with the same vertex angle as the tapering end of the tubular body 2.

The bottom of this base 3 on its frontal side has a circular central opening of cylindrical shape with, projecting from its cylindrical surface, an annular ridge 7 which in transverse section is the shape of a right triangle, so that it has an introduction ramp on the same side as the conical bore 3*a*, and a catching tooth on the same side as the external or frontal face of the base.

The bottom piece 4 has a frustoconical external profile with the same vertex angle as the tapering end 2*a* of the tubular body 2 and as the bore 3*a* of the base 3. This bottom piece 4 has a small-diameter frontal end with a cylindrical boss of the same diameter and same length as the circular central opening in the bottom of the base 3, which opening is intended to act as a housing for it. This boss has an annular groove 8 with a cross-section which complements that of the ridge 7, the annular groove and the ridge being arranged in such a way that one can be engaged over the other when the frontal boss of the bottom piece is itself fully engaged in the central opening in the bottom of the base 3.

This arrangement allows the bottom piece 4 to be assembled with the base 3 by snap fastening.

The characteristics of flexibility and elasticity of the bottom piece 4 are obtained by forming annular teeth or striations of triangular transverse section on its external wall.

The bottom piece 4 on the distal side has a recess 9 which is frustoconical or the shape of a hyperbola. The frontal boss on this same piece has a cylindrical central opening 10 communicating with the aforementioned recess 9 and intended to act as a housing for the priming device of the cartridge built with this case. The piece 4 has an annular lip 11 bordering the interior end of the well 10 which is intended to act as a housing for the cartridge primer. The presence of this lip 11 reduces the risk of the primer being expelled.

In accordance with the present invention, the frustoconical region of connection between, on the one hand, the tapering assembly end 2*a* and, on the other hand, the frustoconical bore 3*a* of the base 3, is broken down in the axial direction of the tubular body into a sealed connection region 20, and a superimposed collar 6 of welding, as represented in the single FIGURE, the base being arranged at the bottom.

The sealed connection region 20 is obtained by tightly fitting a ring 2*c* belonging to the tapering assembly end 2*a* of the tubular body 2 into a lip 3*b* belonging to the base 3.

This sealed connection region 20 extends from the posterior line 7 of contact between the base 3 and the assembly end 2*a*. The collar 6 of welding is obtained with conventional ultrasound-type plastic welding equipment, and in particular with appropriate tools interacting with the two electrodes of a sonotrode. In order to have enough plastic to obtain the welded joint, longitudinal ridges (not represented) are added or formed on the frustoconical bore of the base 3 and/or on the external surface of the tapering assembly end, this being done prior to the assembly of these two parts and to the ultra-sound welding.

As shown in the FIGURE, the collar 6 of welding between the assembly end 2*a* and the frustoconical bore 3*a* of the base 3 extends from a distal boundary 6*b* adjacent to or some distance from the sealed connection region 20 described earlier, to a frontal boundary 6*a* adjacent to or distant from the anterior boundary 2*b* of the tubular body 2.

As also shown in the FIGURE, this anterior boundary 2*b* of the tubular body 2 is arranged and remains some distance from the posterior shoulder 3*b* formed in the base 3, so as to form a gap with no material in it, including after welding.

Along a generatrix of the frustoconical region of connection between the assembly end 2*a* and the frustoconical bore 3*a* of the base 3, and therefore along a generatrix of the collar 6 of welding, the length of the latter is at least equal to half the length of the frustoconical connection between this assembly end 2*a* and the frustoconical end 3*a*.

I claim:

1. A cartridge case, comprising:

three elements made of plastic, a tubular body with an assembly end which tapers into the shape of a cone frustum, a base which has a frustoconical bore with a vertex angle substantially the same as and complementary to a vertex angle of the tapering assembly end of the tubular body to which it is matched, the base acting as a housing, and a bottom piece with a frustoconical external profile of substantially an identical vertex angle as the tapering assembly end of the tubular body and the bore of the base, wherein the frustoconical connection between the tapering assembly end and the frustoconical bore of the base in an axial direction of the tubular body comprises:

a region of sealed connection between a ring of the tapering assembly end of the tubular body and a lip of the base, the ring fitted into the lip, the sealed connection region extending from a posterior line of contact between the base and the tapering assembly end; and a collar of welding between the tapering assembly end and the frustoconical bore of the base, the collar of welding extending from a distal boundary adjacent to or some distance from the sealed connection region to a frontal boundary adjacent to or distant from an anterior boundary of the tubular body, the anterior boundary arranged some distance from a posterior shoulder of the base.

2. The case according to claim 1, wherein an axial length of the collar of welding is at least equal to half a length of the frustoconical connection between the tapering assembly end and the frustoconical bore of the base.

* * * * *